US005234365A

United States Patent [19]

Cooper et al.

[11] Patent Number: 5,234,365

[45] Date of Patent: Aug. 10, 1993

[54] MARKER BUOY APPARATUS

[76] Inventors: Lowell T. Cooper, 1305 Seymour; Roger J. Benda, 1409 State St., both of Tama, Iowa 52339

[21] Appl. No.: 873,742

[22] Filed: Apr. 24, 1992

[51] Int. Cl.[5] ..... B63B 22/18; B63B 22/20

[52] U.S. Cl. ..... 441/11; 441/26; 441/28

[58] Field of Search ..... 441/6, 11, 21, 23-26, 441/28, 130; 114/326, 329

[56] References Cited

U.S. PATENT DOCUMENTS

| | | | |
|---|---|---|---|
| 1,256,365 | 2/1918 | Pettit | 114/326 X |
| 1,384,736 | 7/1921 | Ardo et al. | 441/26 |
| 2,192,450 | 3/1940 | Miller | 441/11 X |
| 2,974,331 | 3/1961 | Dize | 441/130 |
| 4,501,563 | 2/1985 | Johnson et al. | 441/6 |
| 5,087,216 | 2/1992 | Noggle | 441/26 |

*Primary Examiner*—Sherman Basinger
*Attorney, Agent, or Firm*—Leon Gilden

[57] ABSTRACT

A marker buoy for temporary indication of various fishing positioning is provided to include buoyant structure to rotatably accommodate a spool therebetween, with the spool rotatably operative through a rotary tool to effect selective winding and unwinding of a support tether line mounting an anchor to the support tether line. A modification of the invention includes various marker flag structure and scent dispensing arrangements in association with the organization.

4 Claims, 4 Drawing Sheets

MARKER BUOY APPARATUS

BACKGROUND OF THE INVENTION

1. Field of the Invention

The field of invention relates to buoy apparatus, and more particularly pertains to a new and improved marker buoy apparatus wherein the same is arranged for the temporary indication of various fishing and nautical positions.

2. Description of the Prior Art

Marker buoy apparatus of various types are utilized throughout the prior art for the temporary or permanent indication within a water way, such as in the indication of hazards, fishing positions, and the like. Such apparatus is exemplified in the U.S. Pat. No. 3,425,070 with a flotation device arranged for providing indication of an underlying nautical component.

U.S. Pat. No. 4,976,641 to D'Amico sets forth a buoy with a self-ejecting weight, as the weight sinks and uncoils a cord from a reel member.

U.S. Pat. Nos. 4,927,395; 4,781,636; and 4,808,133 are further examples of marker buoy structure.

Accordingly, it may be appreciated that there continues to be a need for a new and improved marker buoy apparatus as set forth by the instant invention which addresses both the problems of ease of use as well as effectiveness in construction in providing for the temporary positioning of a mark buoy arrangement permitting the selective winding and unwinding of an anchor device relative to the buoy structure and in this respect, the present invention substantially fulfills this need.

SUMMARY OF THE INVENTION

In view of the foregoing disadvantages inherent in the known types of marker buoy apparatus now present in the prior art, the present invention provides a marker buoy apparatus wherein the same is arranged for the indication of various nautical positions. As such, the general purpose of the present invention, which will be described subsequently in greater detail, is to provide a new and improved marker buoy apparatus which has all the advantages of the prior art marker buoy apparatus and none of the disadvantages.

To attain this, the present invention provides a marker buoy for temporary indication of various fishing positioning to include buoyant structure to rotatably accommodate a spool therebetween, with the spool rotatably operative through a rotary tool to effect selective winding and unwinding of a support tether line mounting an anchor to the support tether line. A modification of the invention includes various marker flag structure and scent dispensing arrangements in association with the organization.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved marker buoy apparatus which has all the advantages of the prior art marker buoy apparatus and none of the disadvantages.

It is another object of the present invention to provide a new and improved marker buoy apparatus which may be easily and efficiently manufactured and marketed.

It is a further object of the present invention to provide a new and improved marker buoy apparatus which is of a durable and reliable construction.

An even further object of the present invention is to provide a new and improved marker buoy apparatus which is susceptible of a low cost of manufacture with regard to both materials and labor, and which accordingly is then susceptible of low prices of sale to the consuming public, thereby making such marker buoy apparatus economically available to the buying public.

Still yet another object of the present invention is to provide a new and improved marker buoy apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
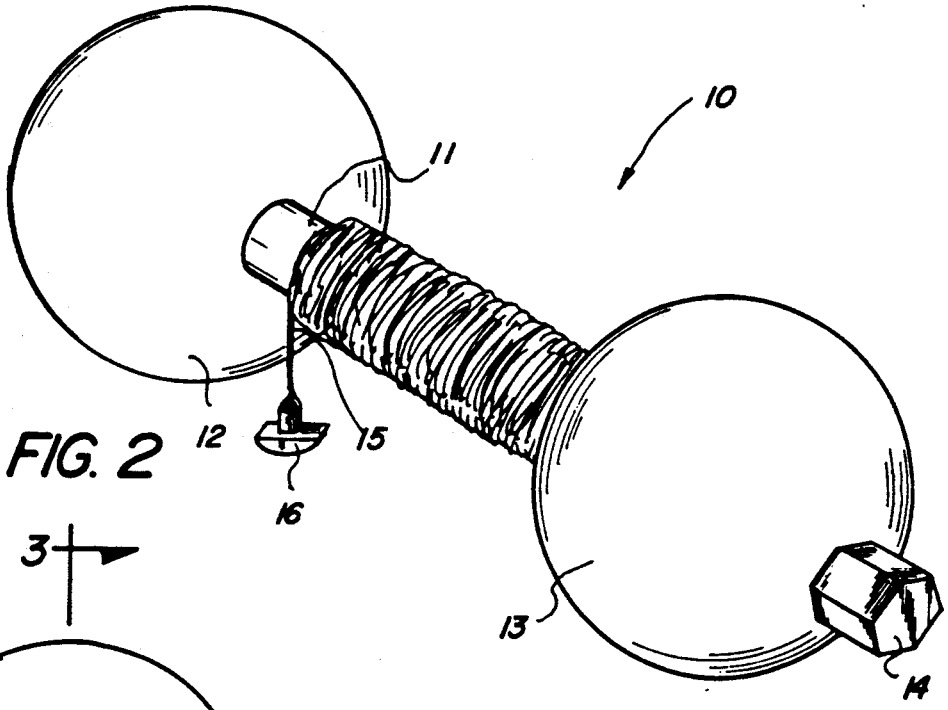
FIG. 1 is an isometric illustration of the instant invention.
Figure 2:
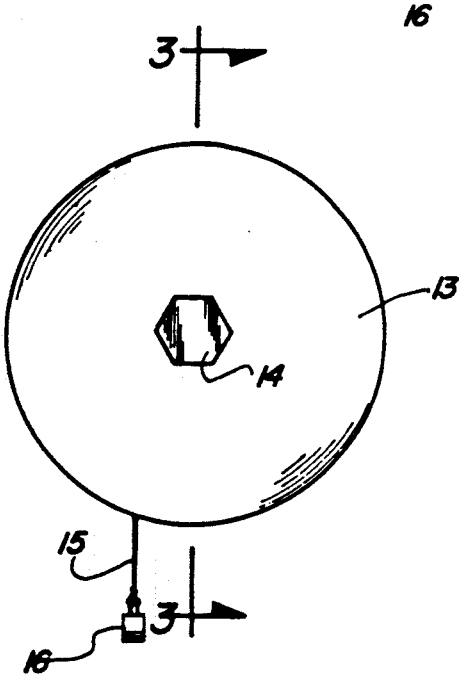
FIG. 2 is an orthographic end view of the instant invention.
Figure 3:
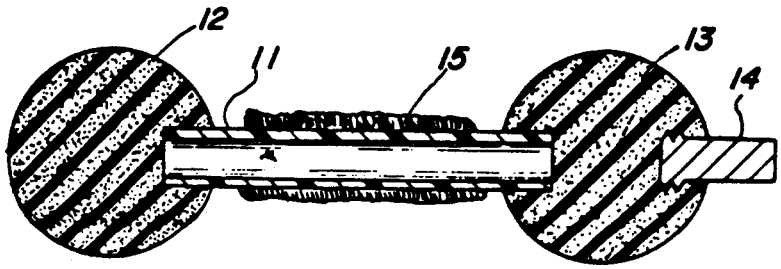
FIG. 3 is an orthographic view, taken along the lines 3—3 of FIG. 2 in the direction indicated by the arrows.

With reference now to the drawings, and in particular to FIGS. 1 to 10 thereof, a new and improved marker buoy apparatus embodying the principles and concepts of the present invention and generally designated by the reference numeral 10 will be described.

More specifically, the marker buoy apparatus 10 of the instant invention essentially comprises a central axle 11 fixedly and coaxially mounted between respective first and second buoyant flotation spheres 12 and 13. The spheres are arranged to permit flotation of the organization upon a body of water. A drive shaft stub 14 projects beyond the second sphere 13 diametrically aligned with the axle 11 on an opposed portion of the second sphere relative to the axle. The stub is typically formed with flats thereon for reception of a drive tool, such as a drive tool 17 illustrated in phantom in FIG. 5, to effect selective rotation of the axle 11 to permit unwinding of a support tether 15 mounting an anchor weight 16 at a free distal end thereof for positioning and placement of the buoy structure. The spheres are typically formed of fluorescent or like colorations to provide for visual attraction relative to the buoy structure 10. In use, the axle structure is merely unwound permitting the anchor weight 16 to be deposited upon an underlying floor of a body of water and subsequent to its use, rewound by use of the tool structure 17 for use at a subsequent period of time.

Figure 4:
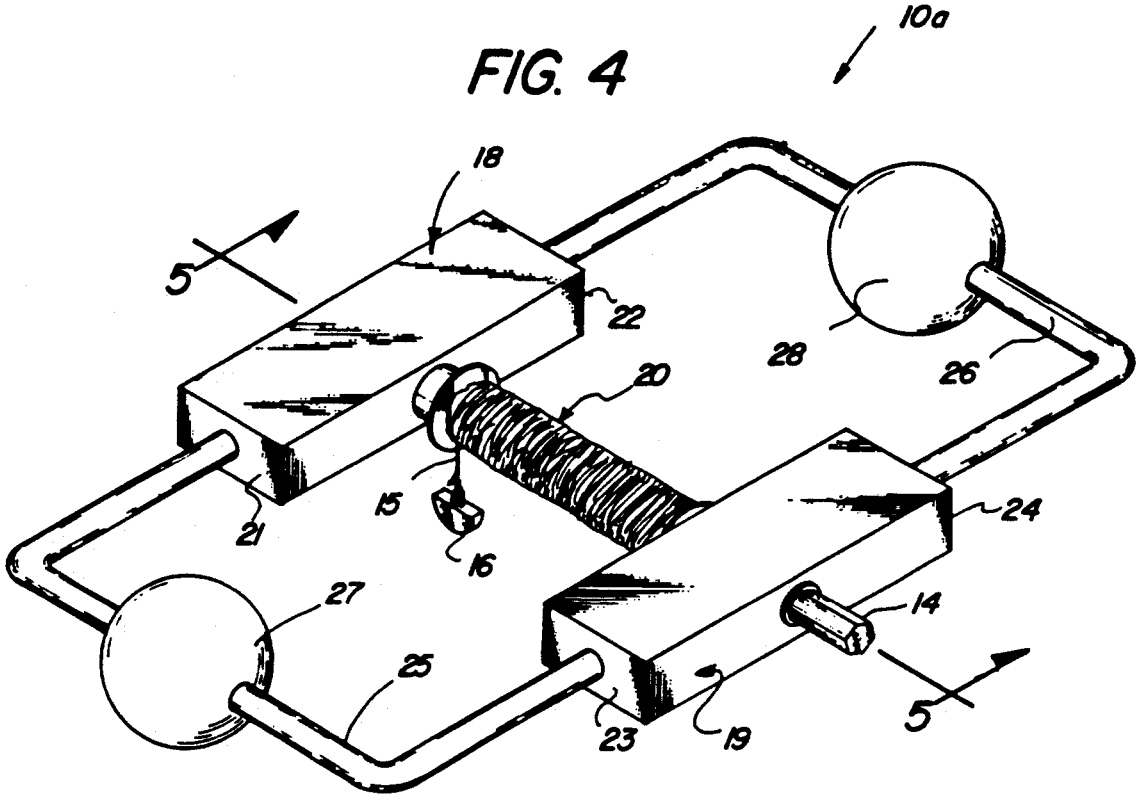
FIG. 4 is an isometric illustration of a modified aspect of the invention.
Figure 5:
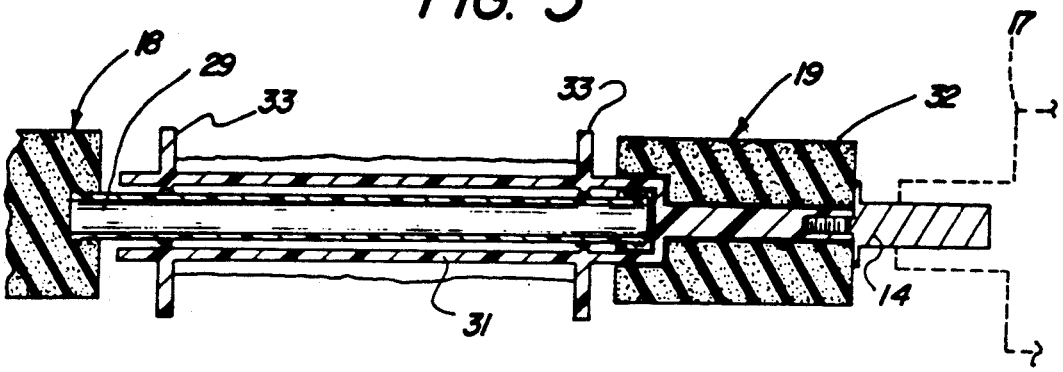
FIG. 5 is an orthographic view, taken along the lines 5—5 of FIG. 4 in the direction indicated by the arrows.

The modified apparatus 10*a*, as illustrated in FIG. 4 for example, employs spaced, parallel first and second buoyant housings 18 and 19 having a first housing first end wall and a first housing second end wall 21 and 22 respectively. The second housing includes a second housing first end wall 23 and a second housing second end wall 24, wherein the first housing first and second end walls are in a parallel relationship and the second housing first and second end walls are in a parallel, spaced relationship. A first U-shaped frame 25 is orthogonally projected beyond the first housing first end wall and the second housing first end wall 21 and 23 respectively. The first U-shaped frame 25 includes a first frame buoyant member 27 mounted medially thereof. The use of a second U-shaped frame 26 extends beyond and in an orthogonal relationship relative to the first housing second end wall and the second housing second end wall 22 and 24, with the second U-shaped frame including a second buoyant member 28 mounted medially thereof. First and second frame buoyant members provide stability to the organization, wherein the first and second U-shaped frames are arranged in a substantial coplanar relationship relative to one another on opposed sides of the first and second frame members. A rigid axle 29 is integrally and orthogonally directed between the first and second housings 18 and 19. A cylindrical sleeve 31 is rotatably mounted about the rigid axle 29 between the first and second housings. The cylindrical sleeve 31 is rotatably mounted about the rigid axle and includes a sleeve axle 32 coaxially aligned with the rigid axle 29, with the sleeve axle 32 directed through the second housing 19 and extending beyond the second housing 19 in the use of the drive shaft stub 14. Further, that upon an application of the drive tool 17 to effect rotation of the stub shaft 14, rotation of the sleeve axle 32 and the associated single sleeve 31 is provided. In this manner, winding and unwinding of the support tether 15 and the associated anchor weight 16 relative to the cylindrical sleeve 31 is effected. Sleeve flanges 33 orthogonally mounted adjacent the respective first and second housings contain the support tether 15 between the flanges 33 on the sleeve 31.

Figure 6:
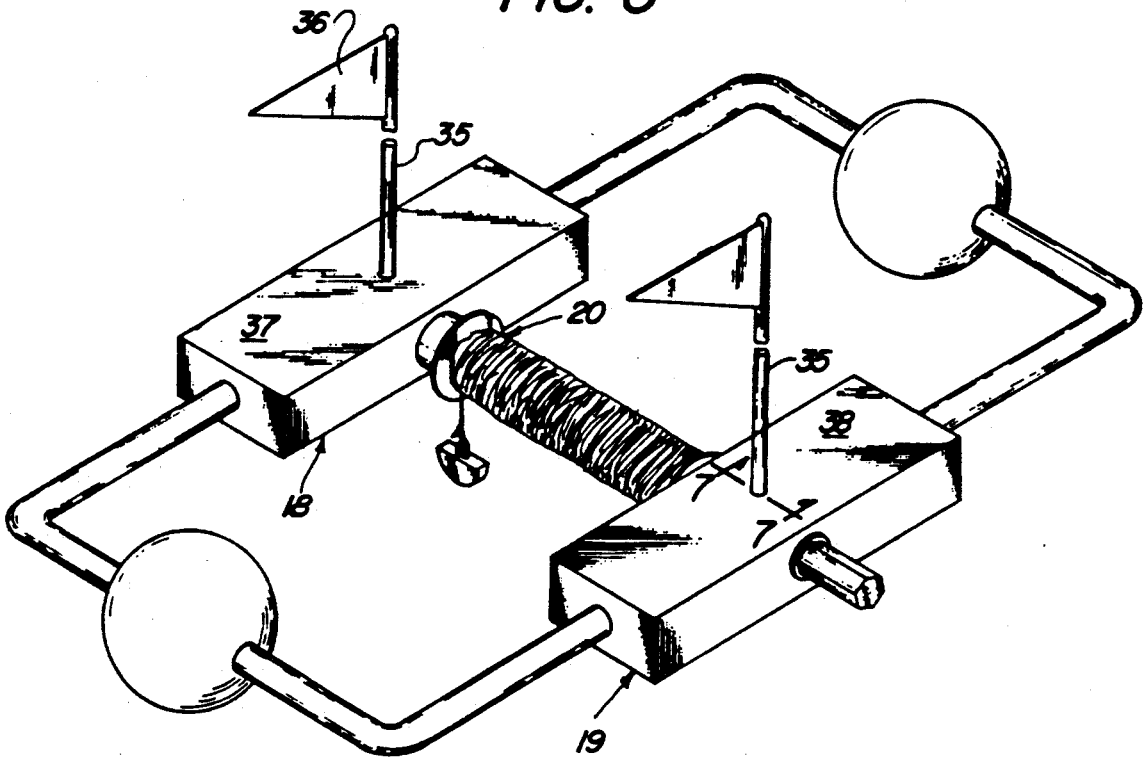
FIG. 6 is an isometric illustration of the invention utilizing marker flag structure.
Figure 7:
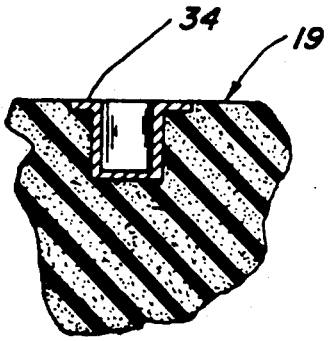
FIG. 7 is an orthographic view, taken along the lines 7—7 of FIG. 6 in the direction indicated by the arrows.
Figure 8:
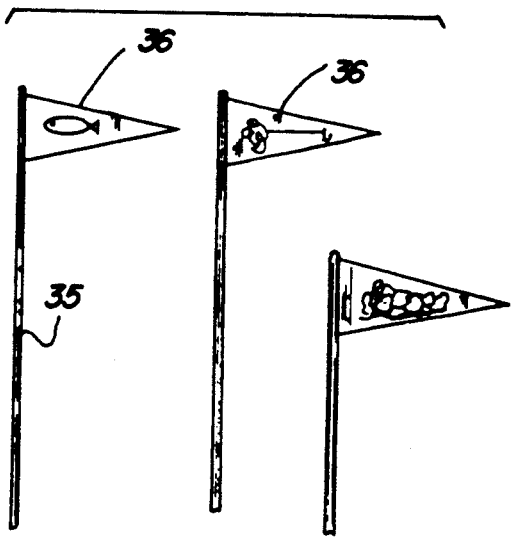
FIG. 8 is an orthographic view of various signal flags utilized by the invention.

The FIGS. 6 and 7 illustrate the use of flag pole sockets 34 directed into the respective first and second buoyant member top walls 37 and 38. The sockets include cylindrical cavities orthogonally oriented relative to the top walls to accommodate flag pole members 35 therewithin. The flag pole members each include indicator flag webs 36 mounted to upper distal ends of the flag members to indicate various conditions such as fishing, hazardous conditions, and the like.

Figure 9:
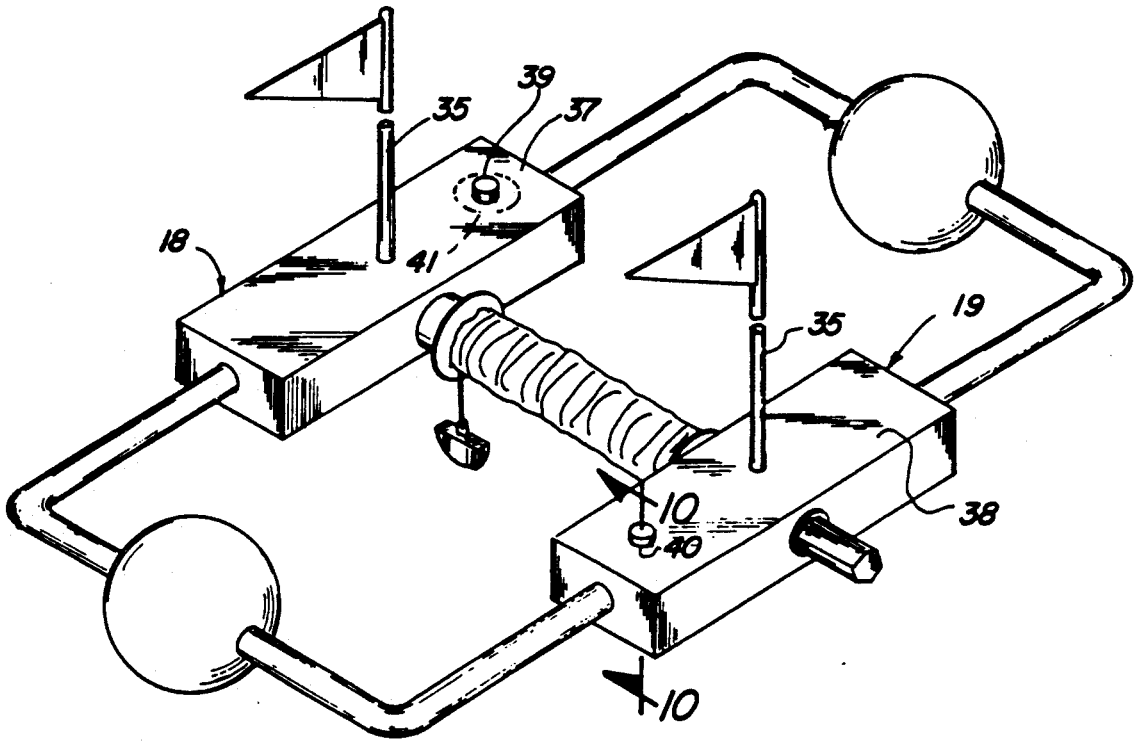
FIG. 9 is an isometric illustration of the invention employing scent dispensing structure.
Figure 10:
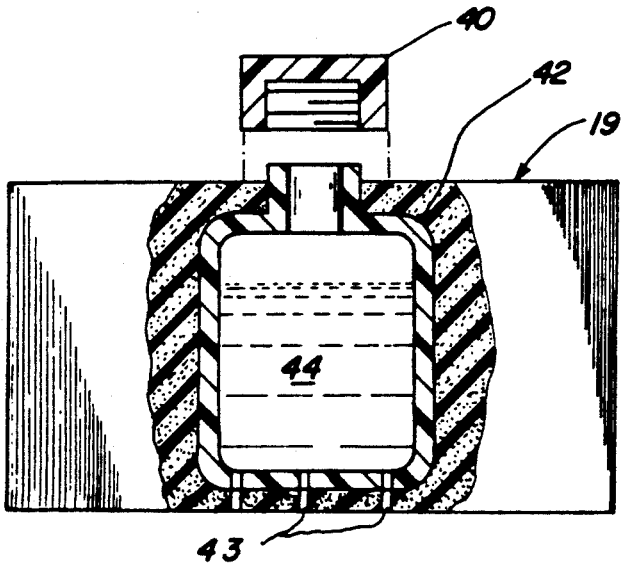
FIG. 10 is an orthographic view, taken along the lines 10—10 of FIG. 9 in the direction indicated by the arrows.

The FIGS. 9 and 10 illustrate the further use of the first and second buoyant housings 18 and 19, including respective first and second fill caps 39 and 40 mounted for removal relative to the first and second buoyant member top walls 37 and 38. The first and second fill caps 39 and 40 permit access to underlying respective first and second reservoirs 41 and 42. Each reservoir includes a matrix of bottom wall apertures 43 (see FIG. 10) to permit a fish attractant and the like fluid 44 to be dispensed through the bottom wall apertures for attracting fish and the like as required. Further, the fluid may be of a dye coloration to enhance visual indication of the buoy structure in use, as required.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A marker buoy apparatus, comprising,

A first buoyant housing spaced from a second buoyant housing, and an axle mounted between the first buoyant housing and the second buoyant housing, and tether line means arranged for selective winding about the axle, with the tether line means including a tether line, with the tether line having a tether line free distal end having an anchor weight mounted thereon, wherein the tether line means permits selective lowering and raising of the anchor weight relative to the axle, and the axle is fixedly and orthogonally mounted between the first buoyant housing and the second buoyant housing, and the axle includes a cylindrical sleeve rotatably mounted about the axle, with the cylindrical sleeve positioned between the first buoyant housing and the second buoyant housing, the cylindrical sleeve including a sleeve axle, the sleeve axle directed through the second buoyant housing, and the sleeve axle coaxially aligned with the axle, and the sleeve axle including a drive shaft stub coaxially aligned with the sleeve axle projecting beyond the second buoyant housing for accommodating a rotation tool to effect selective rotation of the cylindrical sleeve upon rotation of the drive shaft stub, and the tether line means including spaced, parallel flanges fixedly mounted to the cylindrical sleeve, with the tether line positioned between the flanges.

2. An apparatus as set forth in claim 1 wherein the first housing includes a first housing first end wall and a first housing second end wall arranged in a parallel relationship relative to one another, the second housing including a second housing first end wall and a second housing second end wall arranged in a parallel relationship relative to one another, and a first U-shaped frame mounted to the first housing and the second housing orthogonally mounted to the first housing first end wall and the second housing first end wall, with the first U-shaped housing including a first frame buoyant member mounted medially thereof, and a second U-shaped frame fixedly and orthogonally mounted to the first housing second end wall and the second housing second end wall, with the second U-shaped frame including a second buoyant member mounted medially thereof to impart stability to the first buoyant housing and the second buoyant housing.

3. An apparatus as set forth in claim 2 wherein the first buoyant housing includes a first housing top wall, the second buoyant housing including a second housing top wall, and each top wall including at least one sleeve socket, each sleeve socket having a cylindrical cavity orthogonally oriented relative to a respective top wall, and at least one flag pole, the at least one flag pole arranged for selective reception within one of said sockets, and the flag pole including an indicator flag web mounted to an upper distal end thereof.

4. An apparatus as set forth in claim 3 wherein the first buoyant housing includes a first reservoir, the second buoyant housing includes a second reservoir, and the first reservoir including a first reservoir fill cap, the second reservoir including a second reservoir fill cap, and the first reservoir fill cap removably mounted relative to the first buoyant housing top wall, the second reservoir fill cap removably mounted relative to the second buoyant housing top wall, and the a second buoyant housing including a second buoyant housing bottom wall and the second buoyant housing bottom wall including a matrix of apertures directed through the second buoyant housing bottom wall in fluid communication with the second reservoir, and fluid contained within the second reservoir to permit selective distribution of said fluid through said second buoyant housing bottom wall through said apertures.

* * * * *